United States Patent [19]

Ehrlich et al.

[11] 3,986,691

[45] Oct. 19, 1976

[54] PHASE SELECTIVE TRACK CIRCUIT APPARATUS

[75] Inventors: Anthony G. Ehrlich, Mount Lebanon; Crawford E. Staples, Edgewood; Donald E. Stark, Penn Hills, all of Pa.

[73] Assignee: Westinghouse Air Brake Company, Swissvale, Pa.

[22] Filed: May 30, 1975

[21] Appl. No.: 582,155

[52] U.S. Cl. ..... 246/34 R; 333/76; 333/77

[51] Int. Cl.[2] ..... B61L 23/16

[58] Field of Search ..... 246/34 R, 34 CT; 333/17 R, 76, 77; 334/56

[56] References Cited

UNITED STATES PATENTS

| | | | |
|---|---|---|---|
| 2,310,797 | 2/1943 | Lea | 334/56 X |
| 2,709,788 | 5/1955 | Schmidt, Jr. | 333/76 X |
| 3,475,702 | 10/1969 | Ainsworth | 333/76 X |
| 3,524,054 | 8/1970 | Smith | 246/34 R X |
| 3,781,540 | 12/1973 | Staples | 246/34 CT |
| 3,821,544 | 6/1974 | Matty | 246/34 CT |

*Primary Examiner*—Stephen G. Kunin
*Attorney, Agent, or Firm*—A. G. Williamson, Jr.; R. W. McIntire, Jr.

[57] ABSTRACT

A frequency selective filter is connected between the track transformer and phase selective unit at the receiving end of a coded phase selective track circuit to reject interfering signals of propulsion current frequency. The series L-C filter comprises a capacitor and a two-winding reactor coil with a resistor permanently connected in series between the two windings. Each winding is tapped to allow a selection of the filter inductance to match track circuit impedance, including impedance bonds and ballast resistance. Taps for short track circuits include the second winding and the resistor to improve signal to noise ratio. Energy for short interlocking track circuits is of a higher frequency, and a special tap on the first winding is selected to enable filter tuning at this other frequency for train detection since basic frequency is still used during code off-time for cab signal control.

8 Claims, 4 Drawing Figures

PHASE SELECTIVE TRACK CIRCUIT APPARATUS

BACKGROUND OF THE DISCLOSURE

Our invention relates to phase selective track circuit apparatus. More particularly, the invention pertains to a frequency selective filter network for use in such a track circuit to reject interfering currents of different frequencies, induced in the rails by propulsion currents, from actuating improper operation of the track relay.

Phase selective track circuits require that the phase angle between the track voltage signal and the reference or local voltage signal be within a prescribed range, for example, within plus or minus thirty degrees of opposition. The track signal unavoidably undergoes a phase shift as it is transmitted from its source to the receiving detector due to the presence of various circuit elements such as a current limiting device, impedance bonds for coupling traction power between track circuits, and the track rails and ballast. Since the amount of phase shifts depends upon ballast resistance (wet vs. dry), it is necessary to assure that the resulting change will, at all times, fall within the prescribed range. The magnitude of the phase shift is also dependent upon factors such as the track circuit length and the values at operating frequency of the impedance of the bonds, the current limiting device, and the load at the receiving end of the circuit. In early installations, phase corrections were made by connecting a capacitor, a resistor, or combinations of these in series with the detector. In multi-track applications in alternating current (AC) electrified territory, there is mutual coupling between the propulsion supply of a given track and an adjacent track which induces a circulating current in this adjacent track circuit. This inductive interference, while not of the same frequency as the track circuit signal, can become great enough under some conditions to disrupt normal operation of the track circuit. Although not unsafe, because the interfering energy is not coded as is the normal signal energy, occurrences of this type can cause undesirable false restrictive aspects to be displayed by the signals. Filters with fixed elements have been used in series with the receiving detector to provide rejection of the induced interference. The fixed reactive elements comprising such filters provide, at a fixed signaling frequency, the requirements of proper rejection and phase correction for only a limited range of track circuit lengths and ballast resistances. Outside this range or at a different signaling frequency, one or both requirements are not met. Thus, an improved filter with variable reactance is needed.

Accordingly, an object of our invention is an improved phase selective track circuit arrangement for use on alternating current electrified railroads.

Another object of the invention is phase selective track circuit apparatus having a variable frequency selective filter adjustable to apply the track circuit to various length track sections having different track and apparatus impedances.

Also, an object of our invention is a frequency selective filter for improving the operation of phase selective track circuits on electrified railroads.

Another object of the invention is a tuned filter unit which has selective external connections to enable its use in phase selective track circuits of any length.

A further object of the invention is a frequency selective filter for phase selective track circuits which includes a capacitor connected in series with two tapped reactor windings which are separated by a series resistor, the winding taps providing inductance adjustment for different length track sections and impedance conditions, the resistor being included in the filter circuit for short track circuits to provide improved signal to noise ratio where critical operating conditions may occur, a special tap being included to shift the tuninng to a second track circuit frequency.

Yet another object of our invention is a phase selective track circuit arrangement including a series L-C filter, at the receiver end, having a selectively variable inductance to match the impedance of different length track circuits to enable tuning to reject induced electric propulsion frequency currents.

A still further object of the invention is a frequency selective filter for use in phase selective track circuits and having a series L-C network with adjustable inductive reactance to tune the track circuit to reject induced currents of other frequencies regardless of the length and parameters of the track circuit.

Other objects, features, and advantages of our invention will become apparent from the following specification and appended claims, when taken in connection with the accompanying drawings.

SUMMARY OF THE INVENTION

In practicing our invention, the frequency selective filter inserted in a phase selective track circuit includes, in a series network, a fixed capacitor, two tapped reactor windings on a common core, and a fixed resistor connected between the two windings. This series network is connected at the receiver end of the track circuit between the secondary of a track transformer coupled to the rails and the input to a phase selective unit which controls the track relay to detect the presence or absence of trains. To maintain the phase shift of the received track voltage away from the local reference voltage within the optimum range of +30° to −30°, different taps of the reactor windings in the filter are selected in accordance with the track circuit parameters. These parameters include circuit length, ballast resistance, and impedances of the source, the load, and impedance bonds used for propulsion current return. Normally, one selected tap is used for longer track circuits, e.g., over 3,000 feet, while a second tap is selected for shorter track circuits of less than 3,000 feet. The resistor is included in the series tuning network when tap selection is made for the shorter track circuits. A special first winding tap is provided to improve tuning when the track current frequency is shifted, usually for short interlocking detector circuits, to a higher value. The resulting alternate coded high and low frequencies, since normal frequency is continued for cab signals, is useful in activating rapid traffic direction reversals for movements between interlockings.

BRIEF DESCRIPTION OF THE DRAWINGS

We will now describe a specific arrangement of a phase selective track circuit including a tuned filter embodying our invention, as illustrated in the accompanying drawings, in which:

FIG. 3 is a graph showing the response of a filter unit of our invention under specific conditions designated in the drawing.

SPECIFIC DESCRIPTION OF THE ILLUSTRATED EMBODIMENT

Figure 1:
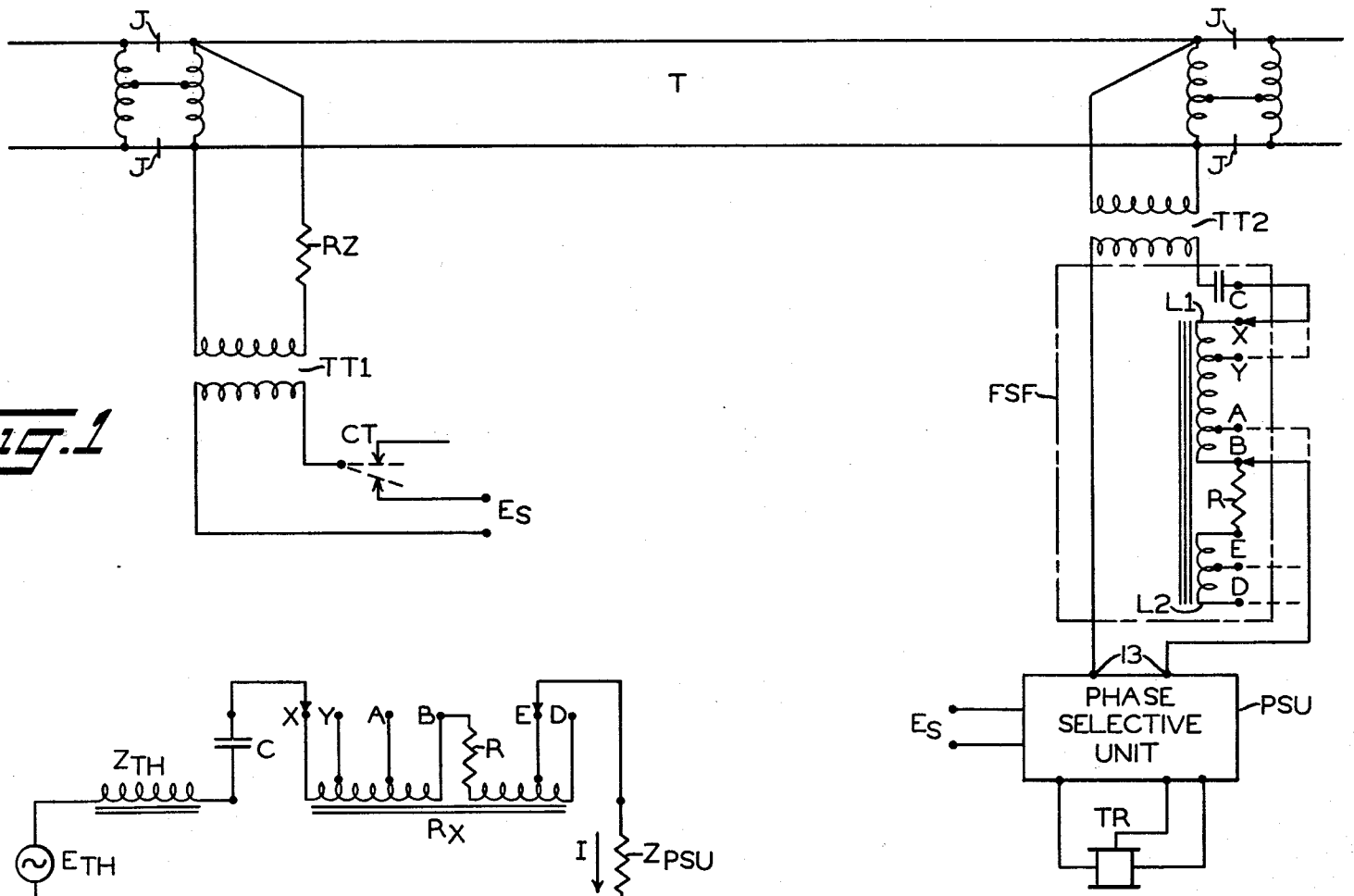
FIG. 1 is a diagrammatic illustration of a phase selective track circuit arrangement, for a single section of track, including the frequency selective filter of our invention.

Referring first to FIG. 1, a track section T, part of a longer track stretch of an A.C. electrified railroad, is shown across the top of the drawing by a conventional parallel line symbol representing the two rails of the track. Section T is insulated from adjoining sections by the insulated joints J shown at left and right ends of the section. To complete the return circuit for the propulsion current, each pair of insulated joints is bypassed by an impedance bond, the windings of which are shown in a conventional manner connected across the rails on each side of the joints and with center taps connected. These bonds are designed to readily pass the alternating propulsion current, which, by way of specific example, may have a frequency of 60 Hz, but to present a high impedance at the higher track current frequency.

Track circuit energy is supplied to the rails of section T at the left end through a track transformer TT1 from an alternating current source $E_s$ which in one specific installation has a frequency of 100 Hz for normal track sections and 200 Hz for short interlocking sections, as will be more fully described. The supply of energy to the primary of transformer TT1 is coded over a back contact of a continuously operating code transmitter CT, in a manner well known in the art.

At the right or receiving end of the section, the track circuit apparatus is coupled to the rails to receive the track energy by a second track transformer TT2. It is to be noted that, if desirable in the specific installation, the track transformer at each end may be combined with the associated impedance bond winding, which then becomes one winding of the transformer in coupling track circuit energy to and from the rails but also continues to serve its function of bypassing the propulsion current around the joints.

Ignoring for the moment the circuit network of the frequency selective filter shown within the dot-dash rectangle FSF, track circuit energy from transformer TT2 is supplied to a phase selective unit PSU shown by a conventional block. This apparatus is similar in design and operation to that shown in U.S. Pat. No. 2,884,516, issued Apr. 28, 1959, to C. E. Staples, for a Phase Sensitive Alternating Current Track Circuit. In the present arrangement, the input to element PSU is direct to transformer winding 13, as referenced in FIG. 1 of the cited patent, and as indicated by the reference 13 designating the input terminals of this unit PSU in the present FIG. 1. The reference or local voltage signal is supplied by the same source $E_s$ used for the track circuit supply, which is common to all locations in the track circuit system. The track relay TR is here shown as a split winding type, which is known in the art, rather than the dual winding type of the prior patent, but there is no change in operation or result. Relay TR repeats the code pulses supplied from the other end of the track circuit when section T is unoccupied by a train.

This code following operation can be decoded in any known manner to provide an occupancy indication for section T and signal control.

The frequency selective, i.e., tuned, filter FSF is an L-C, series circuit network, including a fixed value capacitor C and an inductor or reactor coil having two windings L1 and L2 on the same core. Each winding, in addition to the usual end leads, has selected tap leads to provide an adjustable inductance as needed to tune the filter for various track circuit conditions. Thus, winding L1 has end lead terminals X and B and tap lead terminals Y and A. Winding L2 has one end lead connected direct to one end of a fixed resistor R, another end lead connected to terminal D, and a tap lead terminal E. Lead terminals A, B, D, E, X, and Y and both terminals of capacitor C are mounted externally on the case for filter FSF.

One terminal of the secondary of transformer TT2 is connected direct to one terminal 13 of unit PSU, possibly by an internal lead through unit FSF. The other secondary terminal is connected to the left terminal of capacitor C. The right terminal of capacitor C is selectively connected by the arrowed lead wire to terminal X or Y. Normally, the connection is to terminal X, for the normal frequency track circuits. Where a higher frequency is used for the track energy, connection is made to terminal Y to change the inductance to tune the filter. The arrowed lead connection from the other terminal 13 of unit PSU is selectively made to terminals A, B, D, or E, as indicated by the dotted lines. It is to be noted that the fourth element of filter FSF, resistor R, is permanently connected between terminal B and the upper end of winding L2, i.e., in series with the two windings.

It is to be seen, then, that when the arrowed selective lead from right terminal 13 of unit PSU is connected to terminal A or B, the secondary of transformer TT2, capacitor C, and all or part of winding L1 are connected in series to supply track current to unit PSU. When the selective connection is made to terminal E or D, the transformer secondary, capacitor C, winding L1, resistor R, and all or part of winding L2 are connected in series. This latter arrangement is used for short length track circuits, as will be explained later.

In one specific installation, the normal frequency for track energy is 100 Hz while the higher frequency used under special conditions, e.g., short track circuits in interlockings, is 200 Hz. Cab signal energy is always 100 Hz in this specific system. In longer track circuits, a common supply $E_s$ is used for track and cab signal, coded over the back contact of transmitter CT. When 200 Hz is used for train detection, source $E_s$ in FIG. 1 is of this frequency. Cab signal energy is then supplied during the off-time of the track code from a 100 Hz source over the front contact of transmitter CT, the two sources having a common return.

Figure 4:
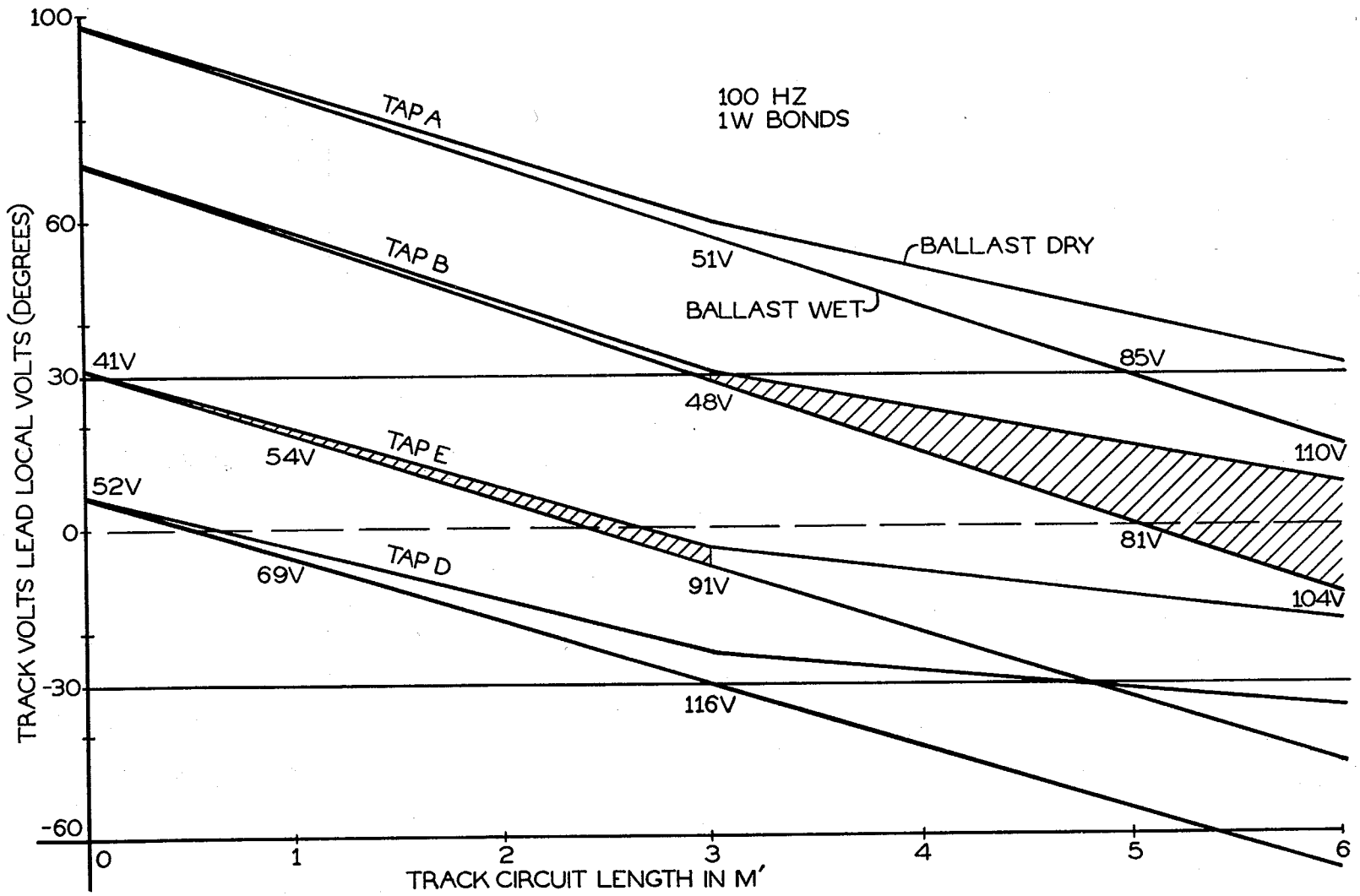
FIG. 4 is a chart illustrating phase shifting of the track signal in a phase selective track circuit for various selective circuit arrangements of the filter unit embodying our invention, under specific examples of track conditions.

We shall now describe separately the operation of the various features of the invention. When reference is made as appropriate to FIGS. 3 and 4, it is to be noted that specific values are given, related to the previously cited specific installation. For example, the curve of FIG. 3 is based on the conditions of a long, 100 Hz track circuit of 6,000 feet, connection from unit PSU to terminal B of unit FSF, the use of 1 ohm impedance bonds, and wet, i.e., low resistance, ballast conditions. In FIG. 4, each pair of wet/dry ballast curves are for a different tap on unit FSF, as indicated, but 100 Hz track current and 1 ohm bonds are assumed for all pairs.

FILTERING AND PHASE CORRECTION

Figure 2:
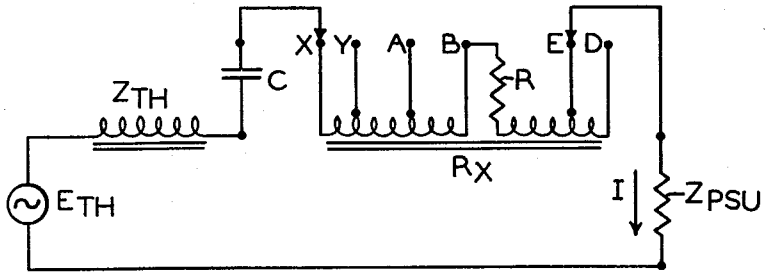
FIG. 2 is an equivalent series circuit of the track circuit shown in FIG. 1.
Figure 2:
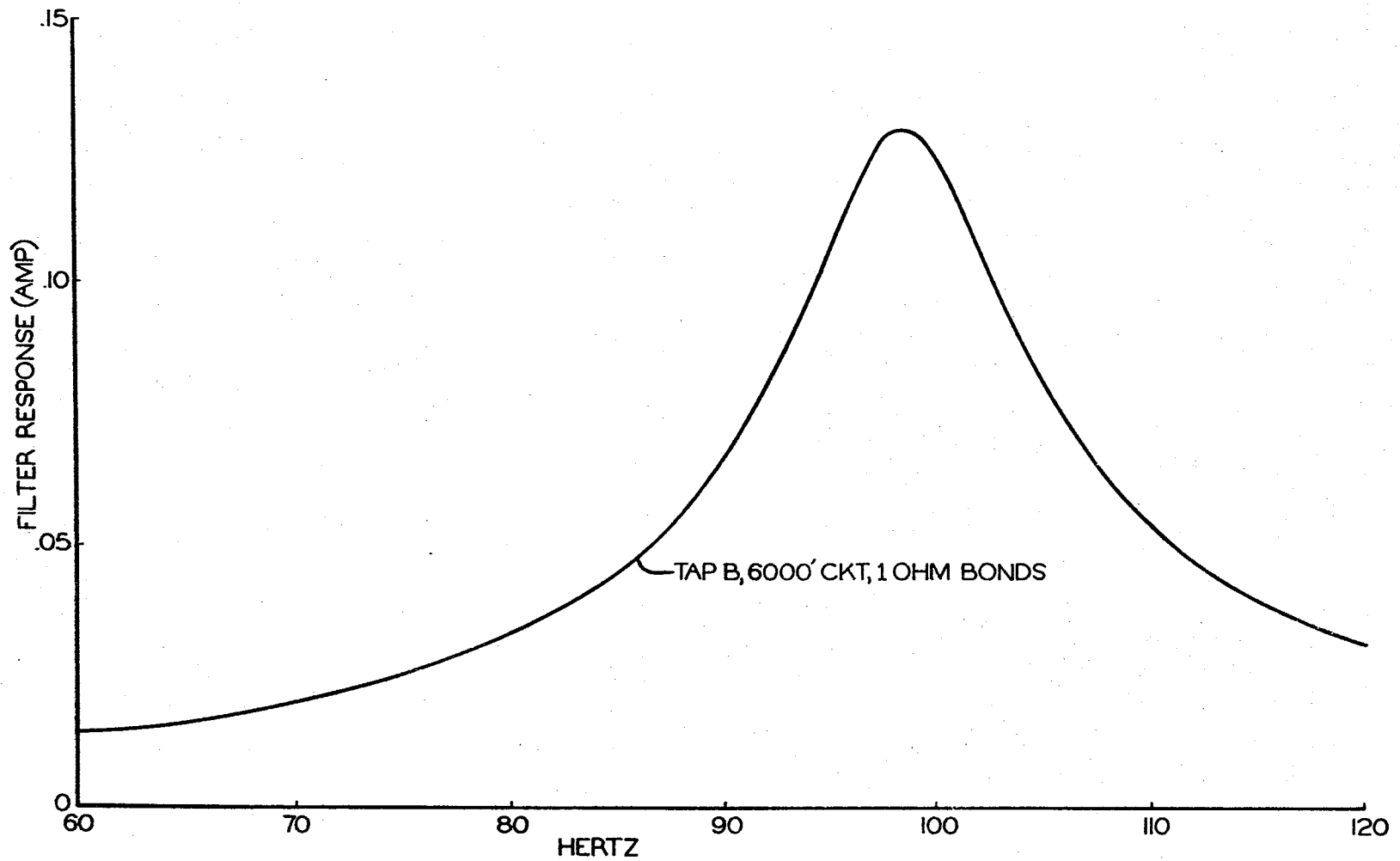

The filtering action is similar to that expected from a conventional series tuned L-C circuit except that the optimum in selectivity is not desired under all operating conditions. As shown in the example of FIG. 3, the peak of the selectivity curve of the overall circuit does not occur exactly at the operating frequency of 100 Hz, the assumed track signaling frequency. Under other conditions, the response peak may occur at or above the operating frequency, rather than below as in FIG. 3. This off-tuning is necessary since, as shown in FIG. 2, the overall track circuit may be represented by an equivalent series circuit comprising the load impedance $Z_{PSU}$, the filter network $R_x$, C, and R, and a Thevenin voltage-source equivalent circuit $E_{TH}$, $Z_{TH}$ for the portion of the circuit including the energy source, rail and ballast resistances, and the impedance bonds. Both the source impedance $Z_{TH}$ and the load impedance $Z_{PSU}$ are inductive, not resistive as in usual filter applications. To tune the overall circuit, the filter network would have to provide the capacitive reactance necessary to nullify the combined inductive reactance components of the filter impedance, the Thevenin impedance $Z_{TH}$, and the load impedance $Z_{PSU}$. On the other hand, proper phase relationships may require that the overall circuit exhibit some reactive component of impedance. To accomplish this requires that the overall circuit be off-tuned. Thus, a typical application will require a compromise between tuning for rejection of interference and off-tuning for phase correction.

FIG. 4 shows the phase relationships (angle between track signal voltage and local element voltage) as a function of track circuit length for four combinations of network filter parameters. It is assumed that phasing is acceptable if the track signal is within ± 30° of opposing the local voltage (reference). The shaded area between the wet and dry ballast curves for Tap B for circuit lengths of 3,000 to 6,000 feet represents a set of operating points for which the track signal voltage is within 30° of opposing the local voltage. In FIG. 4, zero on the vertical axis represents track signal voltage exactly opposing local voltage. For circuits shorter than 3,000 feet, operation is transferred, by means of changing the reactor tap connection, to the shaded area of the pair of curves labeled Tap E. The other two pairs of curves, labeled Tap A and Tap D, allow for flexibility of operation in circuits where ballast resistance is unusually low, or rail impedance is higher or lower than normal, or impedance bond impedance is different from 1 ohm assumed in the example. The point marked 104V on the wet ballast curve (Tap B) at 6,000 feet (FIG. 4) is the operating point for which the overall circuit response curve of FIG. 3 is plotted. The value of 104V is the required signal voltage $E_s$ shown being interrupted by the code transmitter contact in FIG. 1. FIG. 3 shows that the overall circuit resonates at a frequency below the operating frequency. Therefore, the overall circuit impedance exhibits an inductive component which permits proper phase relationships to exist. The other voltage designations shown in FIG. 4 represent required levels of source $E_s$ under different track circuit lengths and filter adjustments.

MULTI-FREQUENCY OPERATION

As previously described, two taps X and Y are provided on filter winding L1 to allow selection of different inductance to tune for the system low and high frequencies. This design yields similar operation at both track circuit operating frequencies, e.g., 100 Hz and 200 Hz, and thus allows the same hardware to be connected for either condition. In actual operation, the track circuit will normally be coded alternately at the two carrier frequencies, as previously discussed. However, the phase selective circuit PSU does not respond when two widely different frequency signals, for example, 100 Hz and 200 Hz, are applied to the track and local inputs since the algebraic sum of the energy to the two coils of track relay TR changes at the difference frequency and the relay cannot respond to this high frequency (100 Hz in this example). The use of an alternately coded circuit allows application of a simplified but reliable wayside traffic circuit logic since a positive "clear circuit" indication is obtained as soon as the track circuit is vacated. This occurrence is used to reset the wayside logic.

SIGNAL TO NOISE RATIO AND SELECTIVE CIRCUIT Q

As often occurs, there may be a potential interfering signal close to the track circuit operating frequency. For example, when the track circuit operates at 200 Hz, the third harmonic of 60 Hz falls only 20 Hz below the track signal. Since the third harmonic is nearly always at a considerably lower level than the fundamental, it is not as great a threat to track circuit operation, and interference can usually be controlled by proper selection of track circuit signal levels relative to the interference, i.e., adequate signal to noise ratio. However, if a receiving detector intended for operation over a wide range of track circuit lengths and ballast resistances is made less sensitive, requiring higher signal level, protecting it from interference in short track circuits will require that inordinately large amounts of signaling energy be transmitted over the rails in long track circuits. The present arrangement permits sensitivity to be lowered in short track circuits without sacrificing sensitivity in long track circuits by selectively increasing the network resistance only at those filter taps used with short track circuits by inserting filter resistor R (FIG. 1) between taps B and E. If sensitivity is to be reduced in long track circuits, resistor R can be connected elsewhere, or additional resistors can be inserted, in the reactor windings.

In some applications it is necessary to allow the circuit response curve, as shown in FIG. 3, to peak below the operating frequency to provide proper phase correction. If the interfering frequency is lower than the operating frequency, e.g., 180 Hz vs. 200 Hz, the off-tuning may produce better response at the interfering frequency than at the signaling frequency. This effect can be lessened by flattening the response curve (lowering the Q) so as to make more nearly equal the responses at the two frequencies, i.e., improve the signal to noise ratio. The present scheme accomplishes this by inserting resistance R (FIG. 1) in series with the filter reactor when taps E or D are used in short track circuits where this phenomenon is more pronounced due to the inherently sharper Q which short track circuits exhibit because the resistance component of the Thevenin impedance $Z_{TH}$ (FIG. 2) is smaller than in long track circuits. If the Q is to be lowered in long track circuits, resistor R can be connected elsewhere, or additional resistors can be inserted, in series with the reactor windings.

MINIMUM ENERGY CONSUMPTION

A resonated circuit (series tuned) results in minimum circuit impedance, so that minimum signal input energy is required to obtain a given output signal. Referring to FIG. 2, resonance occurs when the capacitive reactance of C equals the combined inductive reactance of the source impedance $Z_{TH}$, the load impedance $Z_{PSU}$, and the filter reactor $R_x$. Under this condition, the current I into the receiving detector is in phase with the Thevenin equivalent source voltage $E_{TH}$, and the load voltage across $Z_{PSU}$ leads the current I because the load impedance has an inductive component. Additionally, the equivalent source voltage $E_{TH}$ is out of phase with the supply voltage ($E_s$ in FIG. 1). All of these factors must be considered in establishing the most desirable filter tap selection for a given track circuit so that the best compromise is reached between operation at unity power factor and realization of acceptable phase relationships under changing ballast conditions along with proper interference rejection. FIG. 3, along with the point marked 104V on FIG. 4, shows how the compromise is effected in a specific example.

The apparatus disclosed by this invention thus provides an improved phase selective track circuit which has better frequency selectivity, i.e., greater interference rejection, a better signal to noise ratio under difficult operating conditions, and uses a minimum of power for operation. These advantages are provided chiefly by the frequency selective filter component with its adjustable inductance and a fixed resistor inserted between the two reactor windings. All features are accomplished in an efficient manner with a minimum of additional apparatus, thus achieving an economical track circuit arrangement.

Although we have herein shown and described only one track circuit with filter arrangement embodying our invention, it is to be understood that various changes and modifications may be made within the scope of the appended claims without departing from the spirit and scope of the invention.

Having thus described our invention, what we claim is:

1. For use in a phase selective track circuit for a railroad track section, said track circuit including a source of energy of selected frequency coupled to the rails at one end of the corresponding track section, a track coupling means connected to the rails at the other end of said section, and a phase selective means connected to said source and also selectively coupled through said track coupling means for receiving phase shifted energy through said rails when the section is unoccupied by a train, a tuning filter arrangement comprising, a. a reactor means having a first and a second winding, each winding having at least one tap lead between the end leads for selecting an inductance value different than the full winding inductance, b. a capacitor having a preselected impedance value, c. a resistor having a preselected resistance value, d. said capacitor, said first winding, said resistor, and said second winding in order being connected in a series network and connected at the capacitor end to said track coupling means, e. a selective connector lead connected for completing the coupling of said phase selective means to said track coupling means through said series network, 1. said connector lead being selectively connected to the tap or end lead of either winding for tuning the phase selective means path to substantially said selected frequency and for matching the rail circuit impedance to establish the phase relationship of the input signals to said phase selective means within a predetermined optimum range, 2. said connector lead being connected to the first winding tap or near end lead when the track circuit has greater than a preselected length and selectively to the second winding tap or end lead to include said resistor in the phase selective means coupling when the track circuit has less than said preselected length.

2. A phase selective track circuit arrangement, for a section of electrified railroad track, comprising in combination, a. a source of alternating current of a selected frequency different from propulsion energy frequency, coupled to the rails at one end of said track section for supplying operating energy to said track circuit, b. a phase selective means coupled to said source and, when also coupled to said rails at the other end of said section, responsive to the reception of a track voltage signal having a predetermined phase relationship with said source voltage for registering the unoccupied condition of said section, c. an L-C series filter network including first and second tapped reactor windings for adjusting the inductance of said network, d. said filter network further including 1. a fixed resistor connecting said first and second tapped windings in series, and 2. a fixed capacitor connected in series to said windings and resistor circuit path and coupled to said rails at said other end of said section, e. said phase selective means being coupled to said rails at said other end of said section through a selected tap on said first or second winding in accordance with the length of the track section for rejecting any signal of the propulsion energy frequency induced into the track circuit and for balancing the total series impedance of said track circuit arrangement to maintain said predetermined phase relationship of said track and source voltage signals received by said phase selective means when said section is unoccupied, 1. taps on said second winding being selected to include said resistor in said series network to reduce the sensitivity of said phase selective means only when the length of said track section is less than a predetermined distance, thus improving the signal to noise ratio of track circuit response.

3. A track circuit arrangement as defined in claim 2 which further includes, a. a code transmission means which alternately closes a first and a second contact at a periodic rate, b. said code transmission means being connected for controlling the transmission of a pulse of operating energy to said rails from said selected frequency source each time said first contact closes, c. said phase selective means being further responsive to the reception of coded energy within the frequency and phase limits to detect an unoccupied track section.

4. A track circuit arrangement as defined in claim 3 which further includes, a. a second source of alternating current having a frequency different from that of said first source and that of propulsion energy, for providing operating energy for short track circuits, b. said code transmission means being connected for controlling the transmission of a second source pulse when said second contact closes for providing operating energy for train detection in short track circuits, 1. said first source being connected for providing a cab signal energy pulse when said first contact closes, c. another tap on said first winding to provide a predetermined inductance adjustment to tune said filter network to said second source frequency, d. said phase selective means being connected to a selected second winding tap and said capacitor connected to said first winding other tap to exclude response by said phase selective means to any but said second source frequency and to increase the sensitivity of said filter network to improve the signal to noise ratio to exclude harmonics of said propulsion frequency.

5. A track circuit arrangement as defined in claim 4 in which, a. said track section is insulated from each adjoining track section in the stretch, each associated pair of of insulated joints bypassed by an impedance bond network, of predetermined track circuit impedance, for providing a propulsion energy return circuit, b. the first or second winding tap to tune said filter network and balance the track circuit equivalent impedance selected in accordance with the track section length, impedance bond impedance, rail and ballast impedances, the equivalent impedance of the source in use, and the effective impedance of the selected filter network.

6. Frequency selective filter apparatus, for a phase selective track circuit which includes the rails of a track section, a source of alternating current energy of selected frequency coupled for supplying track energy to said rails at one end of the corresponding track section, and phase selective means for detecting the occupancy condition of the section when coupled to said source and to said rails at the other end of said section to receive said track energy, comprising, a. a selectable inductance reactor comprising first and second windings, each tapped for adjusting the inductance of that winding, b. a fixed resistor connecting said first and second winding in series, c. a fixed capacitor connected in series with the windings and resistor circuit path to form an adjustable L-C circuit network with the capacitor end coupled to one of said rails at said other end, d. said phase selective means being coupled to said rails through a selected tap on said first or second winding in accordance with the length of said track section, said resistor included with the L-C circuit portion used only when said section length is less than a preselected distance, for selecting the inductance of said reactor to match the impedance of the rail circuit and phase selective means for substantially excluding from said phase selective means induced energy of any frequency other than said selected frequency and for maintaining the phase relationship of signals supplied to said phase selective means within a predetermined range.

7. Filter apparatus as defined in claim 6 in which, a. the stretch of track including said corresponding section is electrified for train propulsion at a frequency different from said selected frequency but with harmonics closely spaced to said selected frequency, b. said track energy is of a frequency preselected for relatively short track sections and is coded alternately on and off for transmitting pulses of track energy into said section rails, c. said phase selective means is coupled to a tap on said second reactor winding for decreasing the sensitivity of said filter to exclude any response by said phase selective means to closely spaced harmonics of said track energy.

8. Filter apparatus as defined in claim 7 in which, a. cab signal energy having a frequency different from said preselected short section frequency and said propulsion frequency is supplied to said section rails during the off time of said track energy code pulses, and in which said L-C circuit also includes, b. another first winding tab at a predetermined inductance adjustment to which said capacitor is selectively connected for changing the tuning response of said filter to exclude response by said phase selective means to cab signal energy.

* * * * *